US006466102B1

(12) United States Patent
Grant et al.

(10) Patent No.: US 6,466,102 B1
(45) Date of Patent: Oct. 15, 2002

(54) HIGH ISOLATION MICRO MECHANICAL SWITCH

(75) Inventors: Peter Grant, Metcalfe; Mike W. Denhoff; Sean Patrick McAlister, both of Gloucester, all of (CA)

(73) Assignee: National Research Council of Canada, Ottawa (CA)

( * ) Notice: Subject to any disclaimer, the term of this patent is extended or adjusted under 35 U.S.C. 154(b) by 0 days.

(21) Appl. No.: 09/672,709

(22) Filed: Sep. 29, 2000

Related U.S. Application Data

(60) Provisional application No. 60/157,793, filed on Oct. 5, 1999.

(51) Int. Cl.[7] ..... H01H 13/00
(52) U.S. Cl. ..... 333/105; 307/125
(58) Field of Search ..... 333/105; 307/125

(56) References Cited

U.S. PATENT DOCUMENTS 5,578,976 A 11/1996 Yao ..... 333/262
5,619,061 A * 4/1997 Goldsmith et al. ..... 257/528
6,127,744 A * 10/2000 Streeter et al. ..... 307/125

* cited by examiner

*Primary Examiner*—Justin P. Bettendorf
*Assistant Examiner*—Damian E. Cathey
(74) *Attorney, Agent, or Firm*—Marks & Clerk

(57) ABSTRACT

A micro-mechanical microwave switch has a signal line formed on a substrate and defining a gap forming an open circuit in the off-state of the switch. A dielectric support, which may be a cantilevered arm, carries a contact to bridge the gap and close the switch in the on-state. At least one shield electrode in the vicinity of the contact creates reduces the coupling across the gap by creating a shunt capacitance or redistributing the electromagnetic field.

21 Claims, 5 Drawing Sheets

HIGH ISOLATION MICRO MECHANICAL SWITCH

REFERENCE TO CROSS-RELATED APPLICATIONS

This application claims the benefit under 35 USC 119(e) of co-pending provisional application no. 60/157,793 filed on Oct. 5, 1999.

FIELD OF THE INVENTION

This invention relates to microwave devices, and in particular to high isolation micromechanical microwave switches.

BACKGROUND OF THE INVENTION

Microwave switches are used in many telecommunications applications, in particular satellites. Such switches should have high isolation, low insertion loss, and low return loss. Typically, the performance of a switch degrades linearly with increasing frequency.

An example of a typical microwave switch is described in U.S. Pat. No. 5,578,976, the contents of which are herein incorporated by reference. In this device, a micro mechanical cantilever arm causes a contact to close a gap in the signal line when the switch is in the on position. The cantilever arm is actuated by electrostatic forces. While the device described in U.S. Pat. No. 5,578,976 offers an improvement in isolation, it is still limited to about −50 dB at 4 GHz.

An object of the invention is to provide an improved microwave switch.

SUMMARY OF THE INVENTION

According to the present invention there is provided a micro-mechanical microwave switch comprising a signal line formed o a substrate and determining a gap forming an open circuit in the off-state of the switch; a dielectric displaceable support member carrying a contact to bridge said gap and close said switch in the on-state; and at least one shield electrode in the vicinity of said gap to reduce the coupling across said gap in the off-state of the switch. The support member is typically a cantilevered arm, although other arrangements, such as a displaceable membrane, can be employed.

In accordance with the principles of the invention, a shield electrode can be placed on the support member for the contact. The shunt capacitance created by the shield electrode significantly reduces the coupling across the gap. A simple shield electrode of this nature will reduce the coupling by as much as 6 dB.

In addition, or alternatively, a shield electrode can be placed under the gap, preferably as a buried layer in the supporting substrate. This serves to re-distribute the electromagnetic field in a manner that also reduces the coupling across the gap. In a preferred embodiment, a shield electrode is fixed above the movable switch contact. In the raised position of the contact, the shield electrode abuts the support member. The shield electrode in this case can be formed on a second substrate bonded to the first.

The invention also provides a method of improving the isolation of a micro-mechanical microwave switch, wherein a signal line formed on a substrate defines a gap forming an open circuit in the off-state of the switch and a displaceable support member carries a contact to bridge said gap and close said switch in the on-state, comprising the step of providing a shield electrode in the vicinity of said gap to reduce the coupling across the gap.

DESCRIPTION OF THE DRAWINGS

The invention will now be described in more detail, by way of example only, with reference to the accompanying drawings, in which.

DESCRIPTION OF THE PREFERRED EMBODIMENTS

Figure 1:
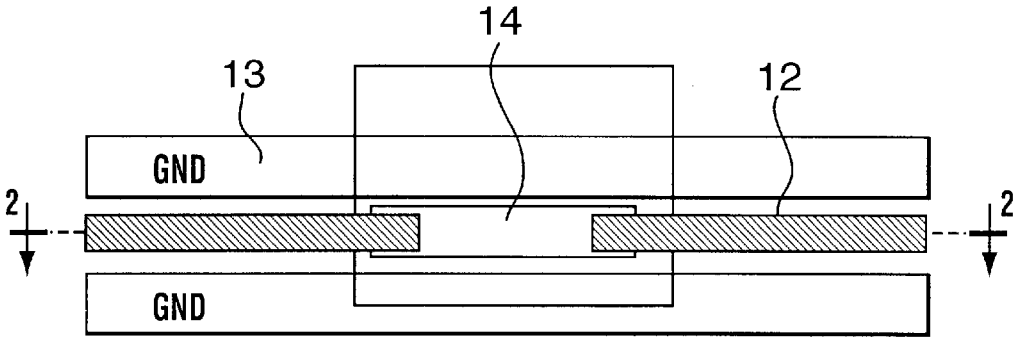
FIG. 1 PRIOR ART
FIG. 1 is a plan view of the contact portion of the microwave switch shown in U.S. Pat. No. 5,578,976.
Figure 2:
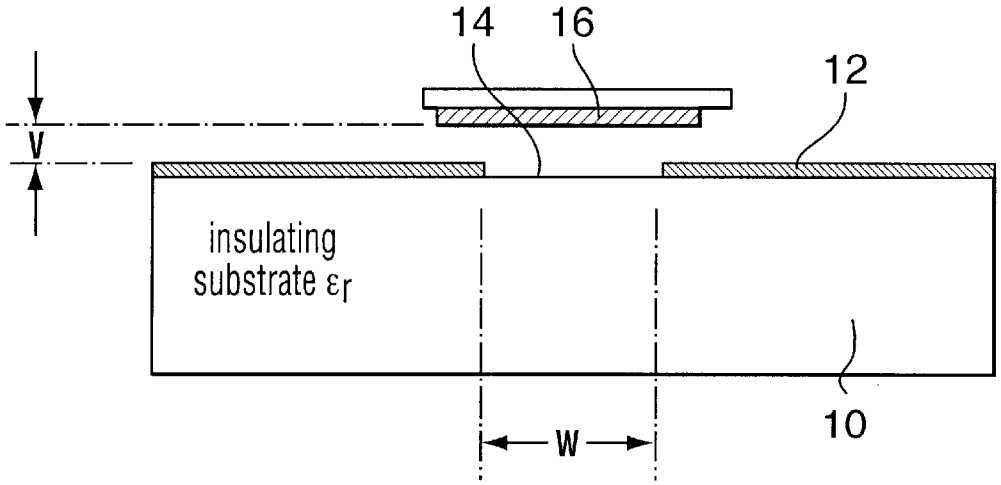
FIG. 2 PRIOR ART
FIG. 2 is a cross-section of the switch of FIG. 1 taken along the section line 2—2.

The switch described in U.S. Pat. No. 5,578,976 is shown in FIGS. 1 and 2. This comprises a GaAs substrate 10 supporting a signal line 12 with a gap 14 closed by a contact 16 when the switch is in the on position. The substrate 10 acts as a thick insulator. Ground plane 13 extends on either side of the signal line 13 in a conventional manner.

The high dielectric constant, $\in_r$, of GaAs mandates a line width of about 20 $\mu$m with 10 $\mu$m spacing on either side. In the off-state, the isolation is limited by coupling along the open contact through gap $\nu$ and across the substrate through gap $\omega$. The relative importance of the effect of gap $\nu;\omega$ has been determined by the inventors to be about 9 to 1.

U.S. Pat. No. 5,578,976 ignores entirely the effect of the substrate coupling and considers only the effect of the gap $\nu$. The patent teaches only that the capacity of coupling can be reduced by increasing the gap $\nu$, which of course requires an increase in the electrostatic actuation voltage. In accordance with the principles of the invention, significant improvements in isolation are achieved without increasing $\nu$.

Figure 3:
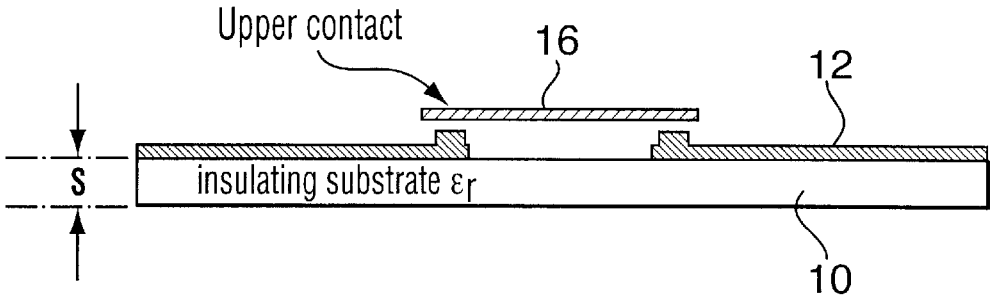
FIG. 3 PRIOR ART
FIG. 3 is a section taken along the signal line of a prior art switch.

FIG. 3 shows a simple prior art switch. In the off-state of the switch, coupling occurs through the open contact 16. The capacitance of this structure can be estimated by assuming a parallel plane model and then doubling it to account for fringing fields. The result of two gaps in series is 4.4 fF (fentofarads) which is larger than the 0.6 fF found for a bare gap.

Figure 4:
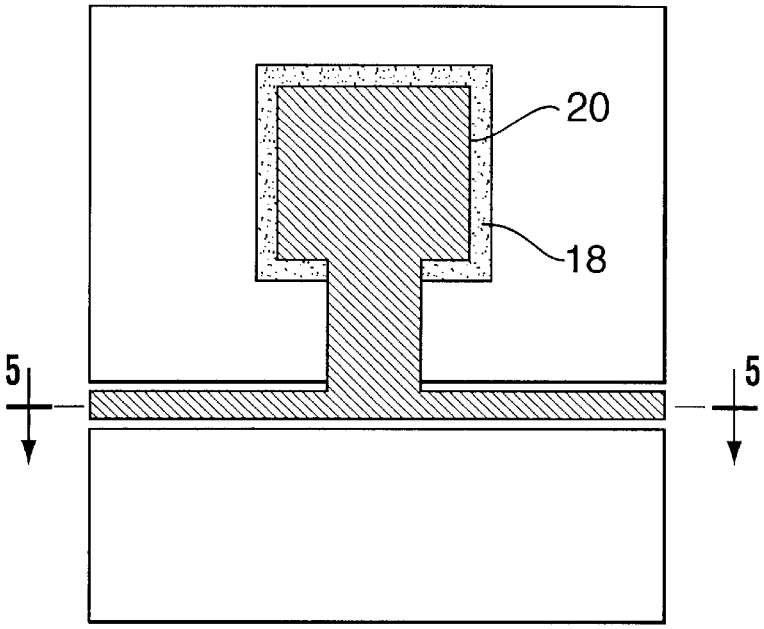
FIG. 4 is a plan view of a switch with a shielded contact.
Figure 5:
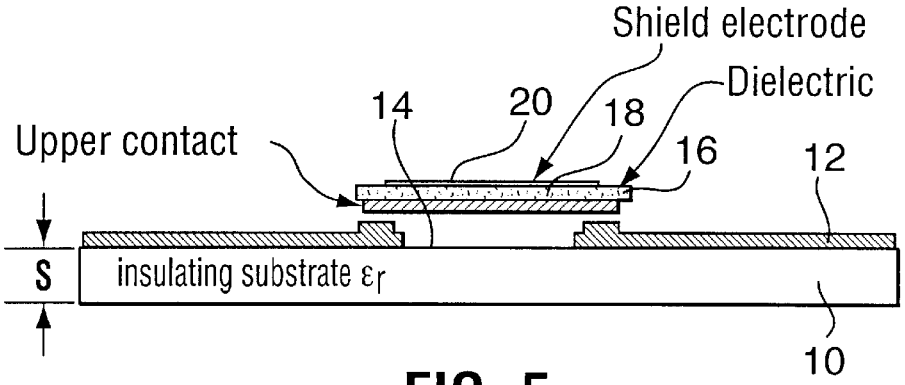
FIG. 5 is a longitudinal section of the switch taken along the section line 4—4 in FIG. 4.
Figure 6:
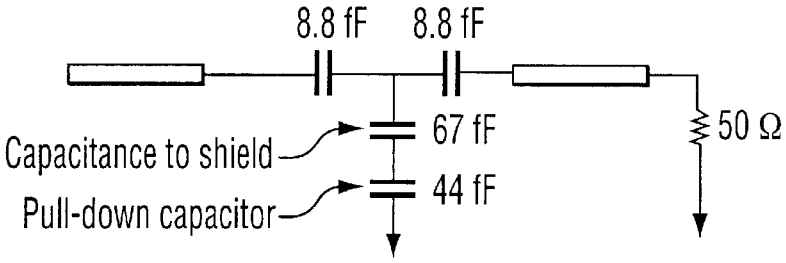
FIG. 6 shows the equivalent circuit for the switch shown in FIGS. 4 and 5.
Figure 7:
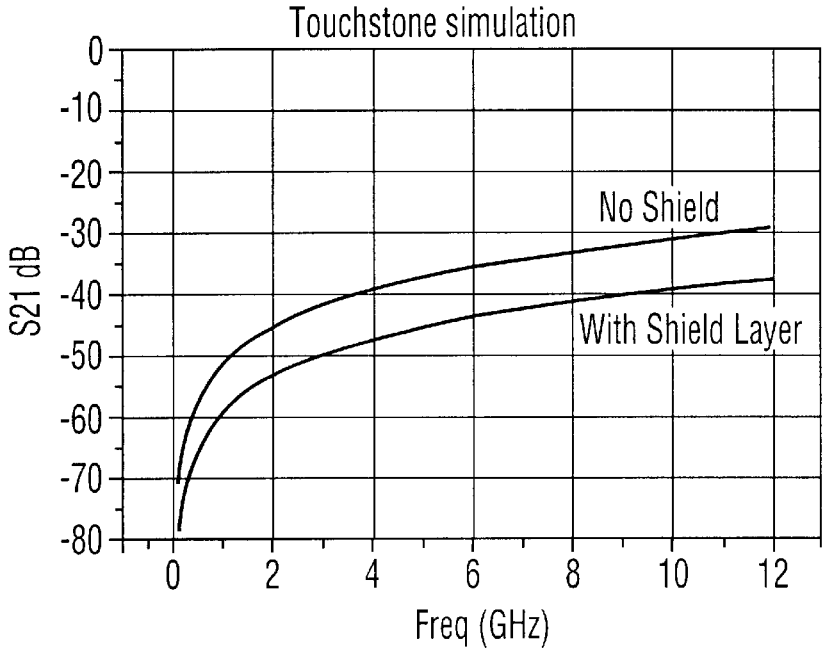
FIG. 7 is a plot showing isolation against frequency for a device with and without a shield electrode.

In FIGS. 4 and 5, the switch made in accordance with the principles of the invention includes a shield electrode 20 placed on dielectric 18 supporting switch contact 16. The effect of adding shield electrode 20 is to add a shunt capacitance 17, as shown in the equivalent circuit in FIG. 6, that reduces the coupling across the gap. Such an electrode gives an improvement in isolation of about 6 dB as can be seen in FIG. 7. As shown in FIG. 6, the capacitance 17 to the shield is typically about 67 fF.

The substrate 10 in this case is quartz, $SiO_2$, which has a dielectric constant of about 3.8, compared to 13.5 for GaAs. The lower dielectric constant of silicon requires a line width of about 60 $\mu$ with a 5.7 $\mu$ spacing on either side. This leads to lower dispersion and permits operation up to frequencies in the order of 40 GHz.

The addition of the shield capacitor creates a return loss when the switch is closed. However because the series capacitance of the switch is small, the shield capacitor can be made small, less than about 10 fP. Also, for some applications, reactive matching can be used to reduce the return loss. For many other applications, the additional return loss will be acceptable.

As in conventional GaAs MMIC switches, resistive material (not shown) should be added to prevent coupling of RF into the control circuitry. Such resistive material does not form part of the invention and will not be described in detail.

Figure 8:
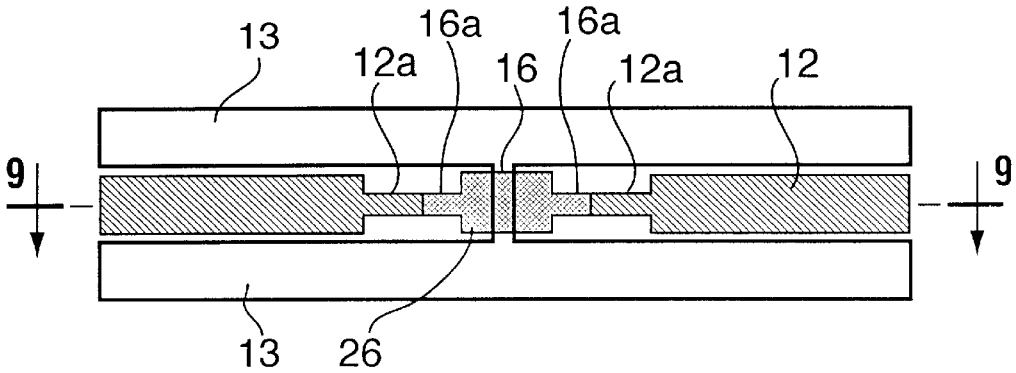
FIG. 8 is a plan view of a switch design with reduced signal line width in the vicinity of the gap.

The switch shown in FIGS. 7 and 8, has portions 12*a* of the signal line 12 of reduced width facing the gap 14. The contact 16 also has portion 16*a* of reduced width facing the reduced width portions of the signal line 12. The central portion of the top contact is wider under the support beam at the center of the gap.

The reduced width of the contact improves isolation in the off-state. The reduced line width has the secondary effect of increasing the transmission line impedance in the on-state The introduction of capacitance can create an impedance mismatch at the gap causing unwanted reflections. Reducing the line width has the effect of introducing inductance, which cancels the effect of the additional capacitance, thereby allowing the impedance to be matched and unwanted reflections eliminated.

The reduction in the width of the signal line in the vicinity of the gap also has a convenient manufacturing advantage. A narrower signal line requires a narrower spacing to the ground plane, which is difficult to fabricate except over small areas. In this embodiment, the signal line width can be maintained larger, except in the vicinity of the gap where the line width is reduced. The fine line width lithography only needs to be carried out over a very small area.

Figure 9:
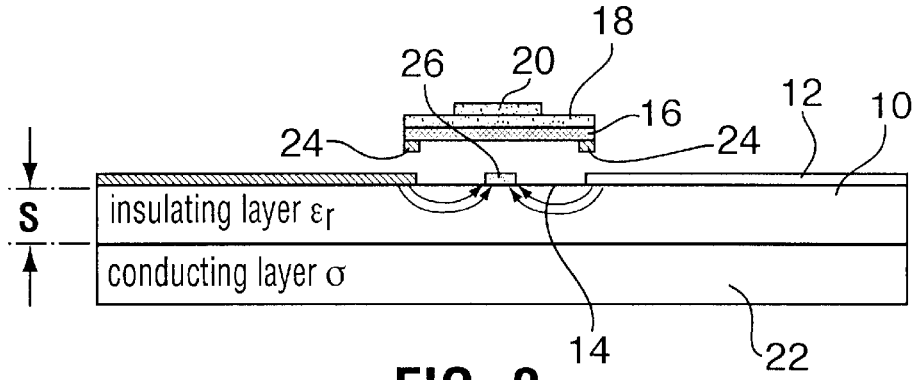
FIG. 9 is a longitudinal section of the switch shown in FIG. 8 taken along section line 9—9.
Figure 10:
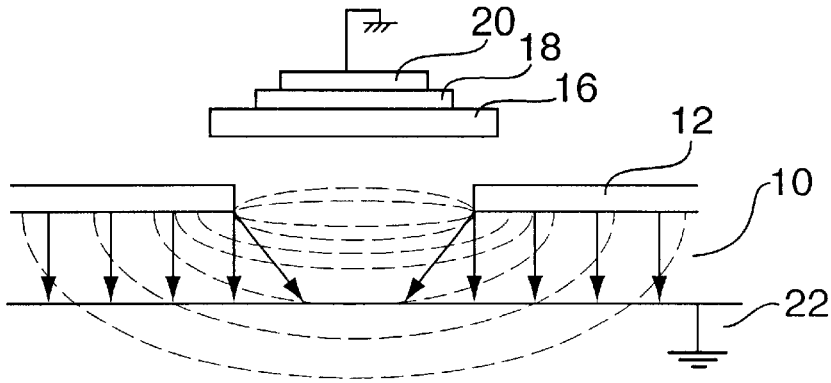
FIG. 10 is a section through a switch showing electromagnetic field distribution.

In the embodiment shown in FIG. 9, an additional conductive layer serving as an underside shield electrode 22 is added on the underside of the substrate 10. This redistributed the electromagnetic field as shown in FIG. 10. The broken lines show the fringing field in the absence of the underside shield electrode 22. The solid arrows show the direction of the field in the presence of the shield 22. The redistribution of the field to the ground plane services to reduce coupling across the gap.

The dielectric material 18 can be made thinner (e.g. reduced from a typical value of 2 $\mu$ to about 0.1$\mu$ to increase the shield capacitance, and also a material with higher dielectric constant, such as $Al_2O_3$, can be used.

Spacers 24 can be introduced on the bottom side of the upper contact 16 to increase the space from the bottom shield 22 to the upper moving contact. Alternatively, these spacers can be provided on the signal line 12.

Figure 11:
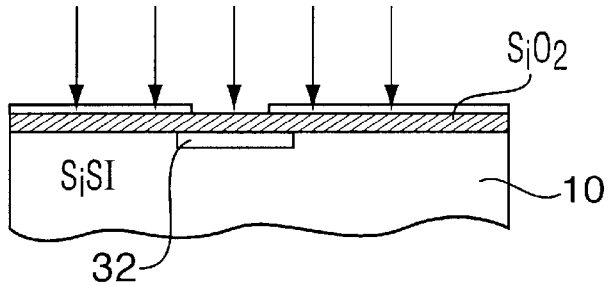
FIG. 11 is a section through a part of a switch with a buried shield.

The fabrication of the underside shield electrode can also be made by forming a buried subsurface $CoSi_2$ layer 32 locally in the $SiO_2$ substrate, as shown in FIG. 11. This can be made by ion implanting cobalt into a suitably masked silicon semi insulating substrate (SiSI) to form a buried subsurface cobalt layer. The substrate is then heated, for example by rapid thermal heat treatment to form $CoSi_2$. The top surface of the substrate is then exposed to oxygen to form an overlaying insulating layer of $SiO_2$. Vias are then made in this insulating layer to contact the buried $CoSi_2$ shield.

An alternative way to redistribute the electromagnetic field is shown in FIG. 9. In this embodiment, a conductive bar 26 is added in the ground plane across the gap 14 In the open condition, the coupling from electric field lines aligned across the gap will be significantly reduced because the field lines will terminate on the bar and capacitive coupling across the gap will be reduced. However, when the switch is closed, with the upper contact down, there will be additional capacitance from the contact to ground, which will introduce a reactive return loss. The size of this unwanted capacitance can, however, be optimized by making the bottom shield 22 narrow and by shaping the upper contact 16 to increase the vertical air gap.

Figure 12:
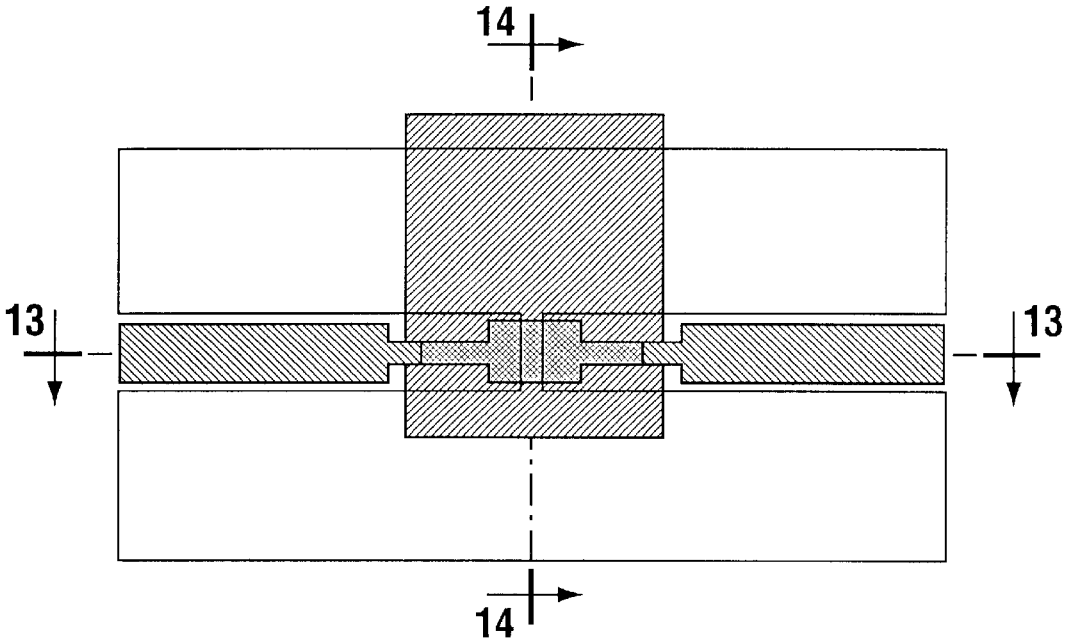
FIG. 12 is a plan view of another switch design.
Figure 13:
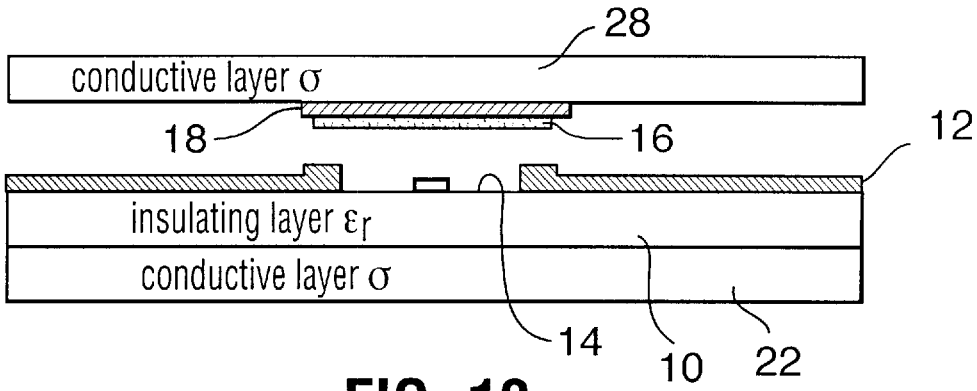
FIG. 13 is a section taken along the line 13—13 of FIG. 12.
Figure 14:
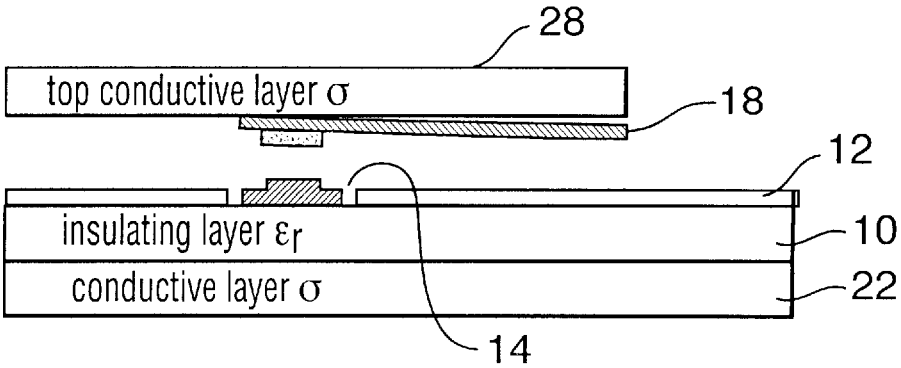
FIG. 14 is a section taken along the line 14—14 of FIG. 12.

The preferred embodiment is shown in FIGS. 12 to 14. In this embodiment a conductive layer 28 is provided above the switch to form a capacitive shield, but unlike the embodiment shown in FIGS. 4 and 5, this shield 28 remains fixed in position when the switch is closed.

Figure 15:
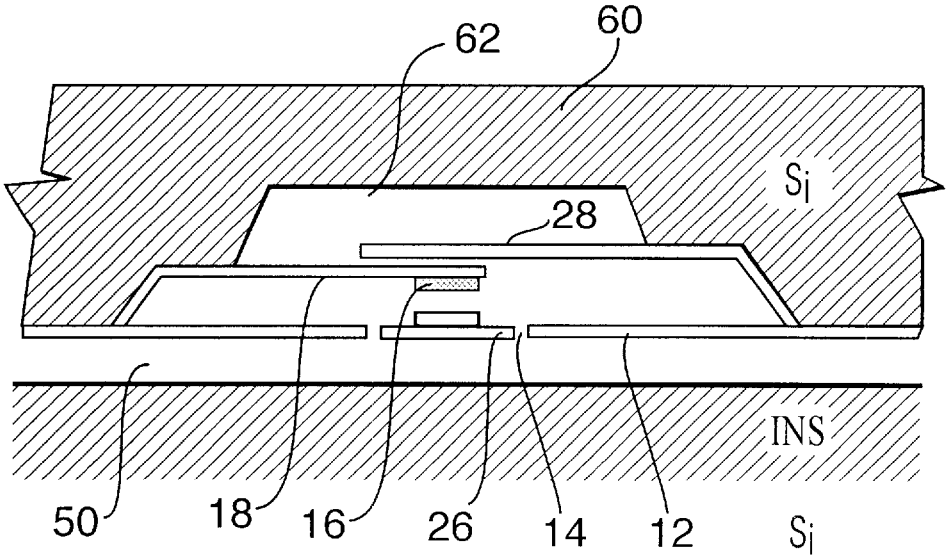
FIG. 15 is a section through a switch design employing a pair of bonded substrates.

This embodiment solves the problem of return loss or shunt capacitance in the on-state. The switch contact 16 is still carried by the dielectric membrane 18, but does not have the shield layer. When the switch open, the contact is raised until it is in close proximity to the static shield 28, as shown in FIG. 15. This arrangement decouples the RF signal on the floating contact and reduces the coupling between the signal lines.

This embodiment can be described as a new switch structure, which behaves more like a strip line than a coplanar waveguide. It can be made from two substrates bonded together as shown in FIG. 15. The dielectric support 18 in the form of a cantilevered and carrying contact 16 is formed on a first substrate 50 along with signal line 12 and bar 26 in gap 14. The cantilever arm is fabricated using sacrificial material in a conventional manner.

The fixed upper shield 28 is fabricated on a second substrate 60 so as to extend over cavity 62. The substrate 60 is inverted and bonded to the substrate 50 so that the upper shield 28 lies over the dielectric support 18.

This design, which is more difficult to make, is expected to have the best performance.

The described switch designs permit the open state coupling to be reduced at frequencies up to 40 GHz.

We claim:

1. A micro-mechanical microwave switch comprising:

a substrate having a surface;

a signal line provided on said surface and having first and second opposed end portions defining a gap therebetween on said surface;

a dielectric displaceable support member carrying a contact member, said displaceable support member being displaceable between an open position of the switch in which said contact member is separated from said first and second opposed portions and a closed position of the switch in which said contact member is in contact with said first and second opposed end portions to provide a bridge therebetween; and a shield electrode extending in a plane generally parallel to said surface and arranged in the vicinity of said gap to provide a shunt capacitance to reduce coupling across said gap in the open position of said switch.

2. A micro-mechanical switch as claimed in claim 1, wherein said shield electrode is formed on said displaceable member extending above and generally across said gap.

3. A micro-mechanical switch as claimed in claim 2, wherein said opposed end portions of the signal line have a reduced line width to increase the transmission line impedance in the on-state and thereby mitigate the effect of shunt capacitance in the on-state.

4. A micro-mechanical switch as claimed in claim 2, further comprising conductive spacers between said contact and said signal line to increase the vertical separation between said contact and said signal line.

5. A micro-mechanical switch as claimed in claim 1, wherein said shield electrode is provided under said gap.

6. A micro-mechanical switch as claimed in claim 5, wherein said shield electrode is a buried layer in said substrate.

7. A micro-mechanical switch as claimed in claim 6, wherein said buried layer is a $CoSi_2$.

8. A micro-mechanical switch as claimed in claim 5, wherein said shield electrode is a conductive layer formed on the underside of said substrate.

9. A macro-mechanical switch as claimed in claim 1, further comprising a grounded conductive bar across the gap to act as a termination for electromagnetic field lines in the vicinity of the gap and thereby reduce capacitive coupling through the switch in the off-state.

10. A micro-mechanical switch as claimed in claim 1, wherein said shield electrode is fixed above said gap, said shield electrode abutting said support member when said support member is in a raised position.

11. A micro-mechanical switch as claimed in claim 10, wherein said switch behaves as a stripline waveguide due to the presence of the said shield electrode above said gap.

12. A micro-mechanical microwave switch as claimed in claim 1, wherein said displaceable support member is a cantilevered arm.

13. A method of improving the isolation of a micro-mechanical microwave switch, wherein a signal line having first and second opposed portions defining a gap therebetween is provided on a surface of a substrate, and a dielectric displaceable support member carrying a contact member is displaceable between an open position of the switch in which said contact member is separated from said first and second opposed portions and a closed position of the switch in which said contact member is in contact with said first and second opposed end portions to provide a bridge therebetween, comprising the step of providing a shield electrode extending generally parallel to said surface in the vicinity of said gap to provide a shunt capacitance to reduce coupling across said gap in the open position of said switch.

14. A method as claimed in claim 13, wherein the shield electrode is provided directly above said gap.

15. A method as claimed in claim 13, wherein the shield electrode is provided below the gap.

16. A method as claimed in claim 15, wherein the shield electrode is provided as a buried layer in the substrate.

17. A method as claimed in claim 16, wherein the buried layer is formed by implanting ions in a substrate to form an ion-implanted layer at a specific depth, heating the substrate to form said ion-implanted layer into a compound with the material of the substrate, and subsequently oxidizing the top surface of the substrate to form an insulating layer over the ion-implanted layer.

18. A method as claimed in claim 17, wherein the substrate is silicon and the buried layer is $CoSi_2$.

19. A method as claimed in claim 13, wherein said shield electrode is fixed above said gap such that said displaceable support member abuts said shield electrode in a raised position.

20. A method as claimed in claim 19, wherein said shield electrode is formed on a second substrate bonded to said first-mentioned substrate.

21. A method as claimed in claim 20, wherein said displaceable support member is a cantilevered arm formed on said first mentioned substrate.

* * * * *